US006467307B1

(12) United States Patent
Watson

(10) Patent No.: US 6,467,307 B1
(45) Date of Patent: Oct. 22, 2002

(54) COLOR-CODED ORNAMENTAL ARTICLE

(76) Inventor: James G. Watson, 9613 Haven Farm Ct. Unit G, Perry Hall, MD (US) 21218-9064

( * ) Notice: Subject to any disclaimer, the term of this patent is extended or adjusted under 35 U.S.C. 154(b) by 0 days.

(21) Appl. No.: 09/949,568

(22) Filed: Sep. 10, 2001

Related U.S. Application Data

(63) Continuation-in-part of application No. 09/864,548, filed on May 24, 2001.

(51) Int. Cl.[7] ..... A44C 5/00

(52) U.S. Cl. ..... 63/3; 63/3.1; 63/3.2; 63/4; 63/29.1; 63/38; 63/DIG. 3; 446/85; 446/120; 446/124

(58) Field of Search ..... 63/1.16, 3, 3.1, 63/3.2, 4, 11, 29.1, 38, 39, DIG. 3; 40/633; 446/85, 102, 120, 121, 124

(56) References Cited

U.S. PATENT DOCUMENTS

| | | | | | |
|---|---|---|---|---|---|
| 326,606 | A | * | 9/1885 | Tingley | 63/11 |
| 409,744 | A | * | 8/1889 | Garben | 446/104 |
| 1,099,484 | A | | 6/1914 | Brassler | |
| 1,318,082 | A | | 10/1919 | Jacoby | |
| 1,605,077 | A | * | 11/1926 | Shelsey | 63/4 |
| 2,228,686 | A | | 1/1941 | Bezault | 63/1 |
| 2,308,402 | A | * | 1/1943 | Taylor | 434/278 |
| 2,540,369 | A | * | 2/1951 | Hume | 446/124 |
| 2,775,093 | A | * | 12/1956 | Kundert | 59/80 |
| 3,204,343 | A | * | 9/1965 | Pollock | 434/195 |
| 3,689,075 | A | * | 9/1972 | Adelsohn | 273/157 R |
| 3,706,523 | A | * | 12/1972 | Kumm | 431/126 |
| 3,768,846 | A | * | 10/1973 | Hensley et al. | 52/127.5 |
| 4,357,744 | A | * | 11/1982 | McKenzie et al. | 29/451 |
| 4,827,575 | A | * | 5/1989 | Delaney | 63/3 |
| 4,928,364 | A | | 5/1990 | Ikeda | 24/614 |
| 5,044,175 | A | | 9/1991 | Razza | 63/1.1 |
| 5,395,245 | A | * | 3/1995 | Heinz | 434/204 |
| 5,444,899 | A | | 8/1995 | Koppelomäki | 24/625 |
| 5,482,491 | A | * | 1/1996 | Kichijyo | 446/112 |
| 5,542,871 | A | | 8/1996 | Gabriel | 446/126 |
| 5,622,293 | A | | 4/1997 | LeFevre | 224/148.2 |
| 5,645,464 | A | * | 7/1997 | Chen | 446/120 |
| 5,778,498 | A | | 7/1998 | Laks | 24/625 |
| 5,871,384 | A | * | 2/1999 | Kichijo | 446/112 |
| 5,895,306 | A | * | 4/1999 | Cunningham | 446/108 |
| 5,954,344 | A | | 9/1999 | Miller | 277/616 |
| 6,076,237 | A | | 6/2000 | Goorhouse | 24/200 |
| 6,083,267 | A | * | 7/2000 | Motomiya et al. | 703/6 |

* cited by examiner

*Primary Examiner*—Robert J. Sandy
*Assistant Examiner*—Andrea Chop
(74) *Attorney, Agent, or Firm*—Robert M. Gamson; Leonard Bloom

(57) ABSTRACT

A color-coded ornamental article worn by a person having a plurality of interconnected pieces. Each piece has a colored face representing a digit according to a given code. The pieces are arranged in a sequence to form a number or date. Each piece has openings in the sides and a connector cap is received in the opening so that adjoining pieces may be interconnected. The connector cap may be a locking or a manually removable type. An end cap closes the openings which are not immediately adjacent to another piece.

2 Claims, 9 Drawing Sheets

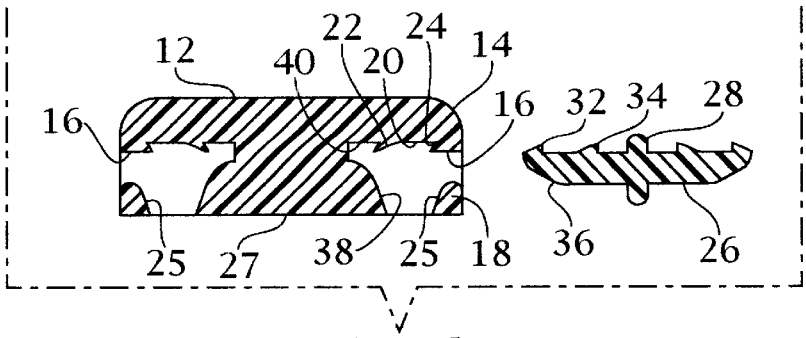
Fig 9
Fig 10
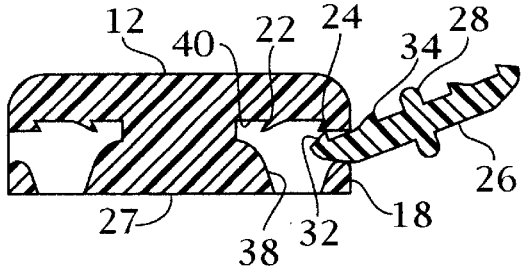
Fig 11
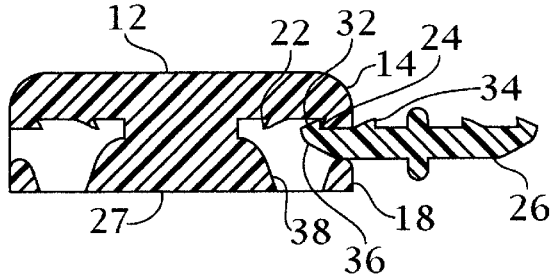
Fig 12
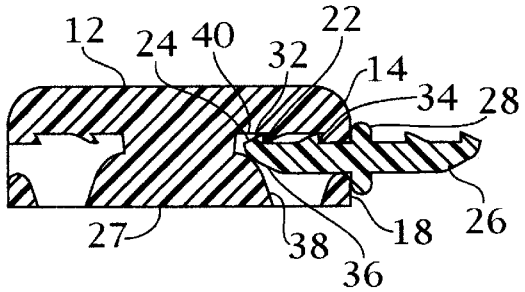

COLOR-CODED ORNAMENTAL ARTICLE

CROSS REFERENCE TO RELATED APPLICATIONS

The present application is a continuation-in-part of application Ser. No 09/864,548, filed May 24, 2001, pending, the disclosure of which is incorporated in its entirety by reference herein.

BACKGROUND OF THE INVENTION

1. Filed of the Invention

The present invention relates to an ornamental article having colors and, more particularly, to an ornamental article which can be assembled with cooperating complementary means to provide a desired sequence of colors.

2. Description of Related Art

In the field of jewelry, it is known to use colored stones and gems for a decorative and aesthetic effect. Usually the colored members are mounted in a setting and arranged in a linear fashion such as a bracelet or necklace having a plurality of connected links or chain.

The colors are not known, by the inventor, to represent numerical values. It would be very helpful to assist persons in remembering numbers which are an important part of life in today's society. Dates for birthdays, anniversaries and special occasions, telephone numbers, social security numbers, are examples of numbers which are important and easily forgotten. An item of jewelry in which specific numbers are represented by different colors is a feature of the present invention.

A further feature is a connector means for interlocking pieces having selected colors to represent the sequence of numbers.

The applicant is aware of the following U.S. patents which disclose connectors but none have a locking connector and a manually-releasable connector like the present invention.

| Inventor(s) | Patent No. |
|---|---|
| Brassler | 1,099,484 |
| Jacoby | 1,318,082 |
| Bezault | 2,228,686 |
| Ikeda | 4,928,364 |
| Razza | 5,044,175 |
| Koppelomäki | 5,444,899 |
| Gabriel | 5,542,871 |
| LeFevre | 5,622,293 |
| Laks | 5,778,498 |
| Miller | 5,954,344 |
| Goorhouse | 6,076,237 |

BRIEF SUMMARY OF THE INVENTION

It is an object of the invention to provide a media which is convenient and aesthetic to display a sequence of numbers which are important to a person.

It is a further object of the invention to provide a connector means to permanently or removably connect colored pieces together to form a bracelet, necklace, or other article of jewelry or attire.

In accordance with the teachings of the present invention, there is disclosed a color-coded ornamental article intended to be worn by a person. The article has a plurality of individual pieces, each of which has a colored face representing a digit according to a given code. The pieces are arranged in a given sequence to form a number or date which has particular significance to the person wearing the article. The pieces have cooperating complementary means thereon for interlocking the pieces together.

In further accordance with the teachings of the present invention, there is disclosed a color-coded ornamental article intended to be worn by a person. The article has a plurality of individual pieces, each of which has a colored face representing a digit according to a given code. The pieces are arranged in a given sequence to form a number or date which has particular significance to the person wearing the article. The pieces have cooperating complementary means thereon for interlocking the pieces together. The article is selected from the group consisting of a bracelet, a necklace and an ankle bracelet. The face of each piece has at least two pairs of parallel sides. The colors represent digits as follows:

0—Black
1—Brown
2—Red
3—Orange
4—Yellow
5—Green
6—Blue
7—Violet
8—Gray
9—White

The means for interlocking the pieces together is a permanent lock.

In still further accordance with the teachings of the present invention, there is disclosed a color-coded ornamental article intended to be worn by a person. The article has a plurality of individual pieces. Each piece has a face and at least three sidewalls. Each sidewall has a respective opening therein defining a lip opposite the face and an inner planar surface substantially parallel to the face of the piece. A distal barb and a proximal barb are formed on the inner planar surface. A connector cap has an enlarged center portion and two opposite arms extending outwardly from the center portion, each arm having a distal protrusion and a proximal protrusion formed thereon. One of the arms of the cap is able to be inserted angularly into the opening of the piece. The one of the arms is then able to be leveraged against the lip. The connector cap is pushed inwardly into the opening to abut the center portion of the connector cap against the sidewall and the lip of the opening. The protrusions on the connector cap engage the barbs on the inner planar surface and the connector cap is interconnected with the piece. The arms of the connector cap each have a side opposite from the distal protrusion, the side being tapered to slope toward the distal protrusion. The opening in the piece has an opposite wall sloping toward the inner planar surface and forming a cavity therein inwardly of the distal barb. The tapered side of the connector cap contacts the sloping opposite wall in the opening when the connector cap is pushed inwardly such that the distal protrusion on the connector cap is received in the cavity. The distal barb engages the distal protrusion and the proximal barb engages the proximal protrusion. The opposite arm of the connector cap is similarly received in a respective opening in a second piece such that the two pieces are connected together.

These and other objects of the present invention will become apparent from a reading of the following specification taken in conjunction with the enclosed drawings.

BRIEF DESCRIPTION OF THE DRAWINGS

FIG. 9 shows the connector cap about to be inserted into the opening in the piece.

FIG. 10 shows the connector cap angled with one of the arms inserted into the opening.

FIG. 11 shows the connector cap leveraged against the lip of the opening.

FIG. 12 shows the connector cap pushed inwardly to lock the connector cap with the piece.

DESCRIPTION OF THE PREFERRED EMBODIMENTS

Figure 1:
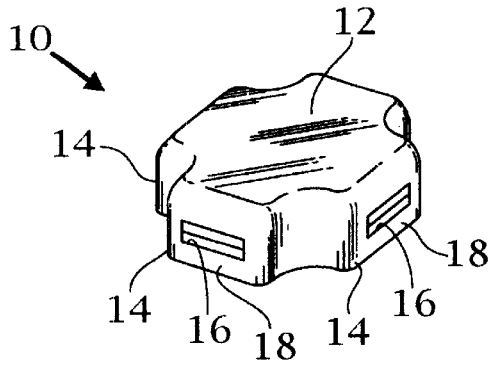
FIG. 1 is a perspective view of one of the individual pieces.
Figure 3:
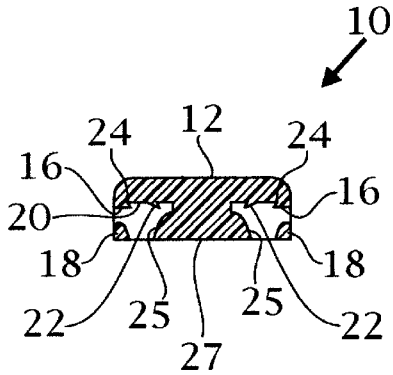
FIG. 3 is a cross-sectional view taken along the lines 3—3 of FIG. 2.
Figure 2:
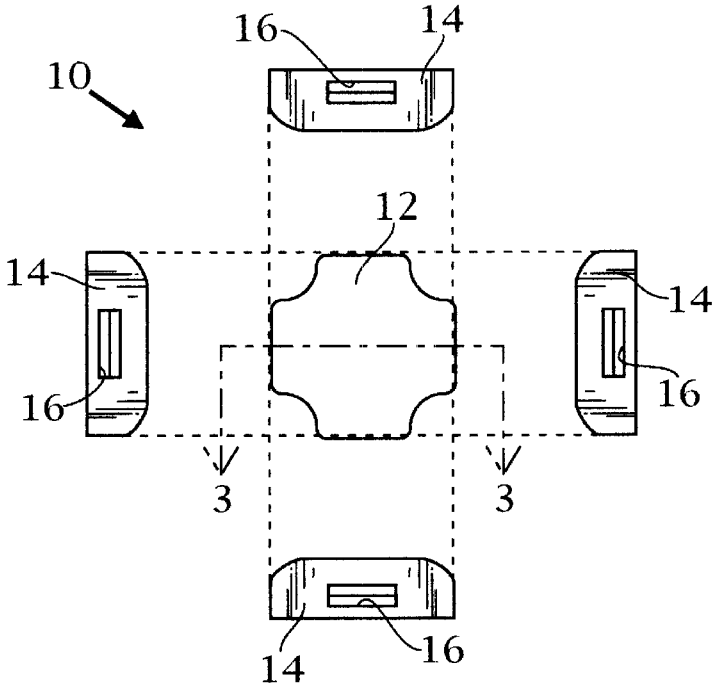
FIG. 2 is a top plan view and side elevation views from the four sides of the individual piece.
Figure 4:
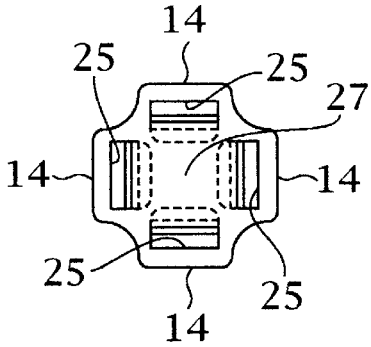
FIG. 4 is a bottom plan view of one of the individual pieces.
Figure 5:
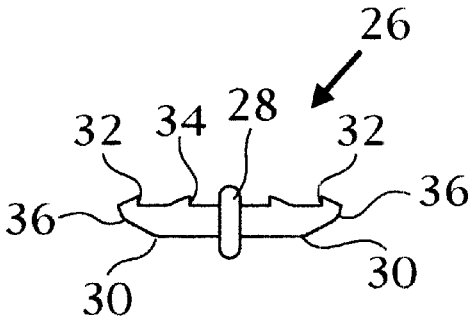
FIG. 5 is a side elevation view of the connector cap.
Figure 6:
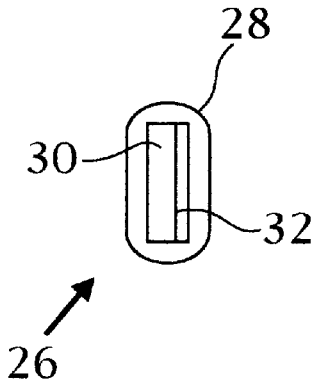
FIG. 6 is an end view of the connector cap.
Figure 7:
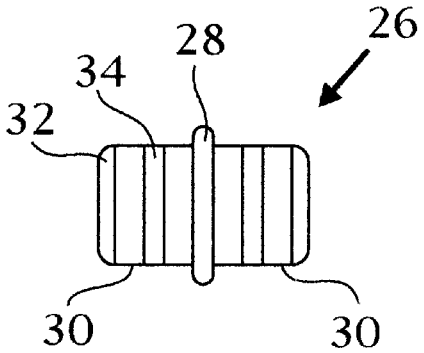
FIG. 7 is a top plan view of the connector cap.
Figure 8:
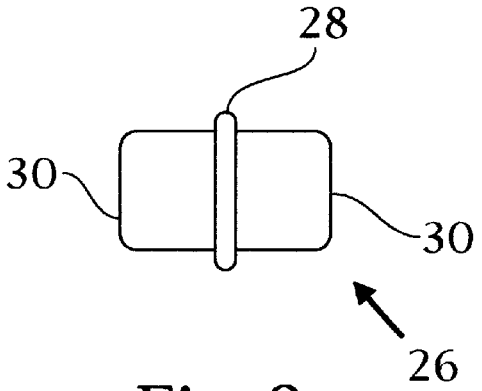
FIG. 8 is a bottom plan view of the connector cap.

Referring now to FIGS. 1–4, one of the plurality of individual pieces 10 of the present invention is shown isolated from any other pieces. Each piece 10 has a face 12 which has a color. As will be described, the color represents a digit according to a given code. The numerical representation corresponding to a color is as follows:

0—Black
1—Brown
2—Red
3—Orange
4—Yellow
5—Green
6—Blue
7—Violet
8—Gray
9—White

Preferably, each piece 10 is substantially square or rectangular having at least two pairs of parallel sides. The corners of the piece 10 are not necessarily right angles but may be rounded or recessed.

Each piece has sidewalls 14 and each sidewall 14 has an opening 16 formed therein. At the tower side of each opening 16, there is formed a lip 18 which is opposite from the face 12 of the piece 10. Each opening 16 defines an inner planar surface 20 which is substantially parallel with the face 12 of the piece 10. Formed on each inner planar surface 20 are a distal barb 22 and a spaced-apart proximal barb 24. Preferably, each barb 22, 24 has a surface which is angled inwardly. The opening 16 in the sidewall 14 also extends through the piece 10 and forms a bottom opening 25 in the bottom 27 of the piece 10. The inner planar surface 20 may be formed near the face 12 of the piece or may be formed near the bottom 27 of the piece 10. the limitations imposed due to manufacturing methods such as injection molding may determine the optimum structure of the opening 16 and the internal formation of the piece 10.

Two or more pieces 10 may be interconnected in any desired pattern to produce the sequence of colors representing the number or date which has significance to the person wearing the article. The pieces 10 may be joined with any sidewall 14 of one piece juxtapositioned to any sidewall 14 of a separate piece 10.

The connection is made using a connector cap 26 as shown in FIGS. 5–8. The connector cap 26 has an enlarged center portion 28 with two arms 30, the arms 30 extending outwardly in opposite directions from the center portion 28. Each arm 30 has formed, on one side thereof, a distal protrusion 32 and a proximal protrusion 34 with respect to the center portion 28. The side 36 of each arm 30 opposite from the protrusions 32, 34 is tapered and slopes toward the distal protrusion 32.

In one embodiment of the connector cap 26, the protrusions 32, 34 are formed in a barb-like manner with one surface of the barb angled from the arm toward the center portion 28.

As shown in FIGS. 9–12, the connector cap 26 is connected to the piece 10 by slightly tilting the connector cap 26 to angularly insert one of the arms 30 into a selected one of the openings 16 in a sidewall 14 of the piece 10. The connector cap 26 is then leveraged in an opposite direction against the lip 18 of the opening 16 until the connector cap 26 is approximately perpendicular to the sidewall 14. The connector cap 26 is pushed inwardly into the opening 16 such that the enlarged center portion 28 abuts the sidewall 14 and the lip 18 of the opening. The enlarged center portion 28 of the connector cap 26 is larger than the opening 16. When so disposed, the distal protrusion 32 on the connector 26 engages the distal barb 22 in the opening 16 and the proximal protrusion 34 on the connector cap 26 engages the proximal barb 24 in the opening 16. Since the protrusions 32, 34 are barb-like and the angled surface thereof engages the inwardly angle surface of the barbs 22, 24 in the opening, the connector cap 26 is secured in a locking connection with the piece 10 and cannot be removed.

Within the opening 10 in the sidewall 14, there is an opposite wall 38 which slopes toward the inner planar surface 20. A cavity 40 is formed between the opposite wall 38 and the inner planar surface 20 which is inwardly of the distal barb 22. When the connector cap 20 is pushed inwardly into the opening 10 in the sidewall 14, the tapered side 36 of the arm 30 of the connector cap 26 contacts the sloping opposite wall 38 and the distal protrusion 32 on the arm 30 is disposed in the cavity 40. Thus, the contact between the sloping opposite wall 38 and the tapered side 36 of the arm 30 combines with the engagement between the barb-like protrusions 32, 34 on the arm 30 and the barbs 22, 24 on the inner planar surface 20, to discourage angling and manipulation of the connector cap 26 in an effort to separate the connector cap 26 from the piece 10.

Figure 13:
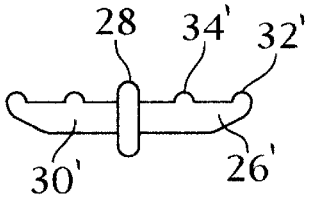
FIG. 13 is a side elevation view of an alternate embodiment of the connector cap which is manually removable.
Figure 14:
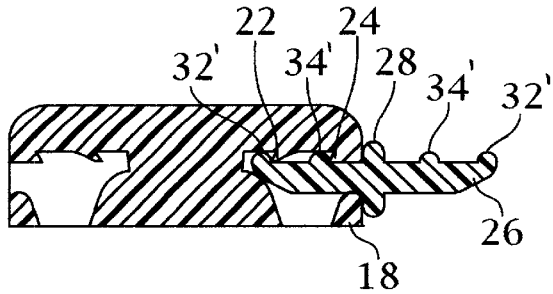
FIG. 14 is a partial cutaway side elevation view showing the manually removable connector cap engaged in the opening in the piece.
Figure 15:
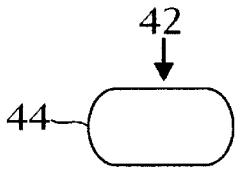
FIG. 15 is a side elevation view of an end cap.
Figure 16:
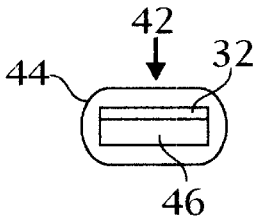
FIG. 16 is a front view of the end cap.
Figure 17:
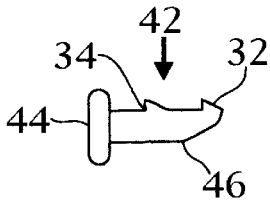
FIG. 17 is a back view of the end cap.
Figure 18:
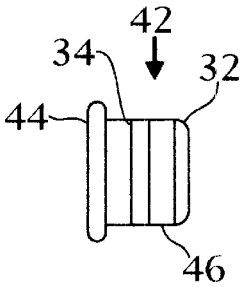
FIG. 18 is a top plan view of the end cap.
Figure 19:
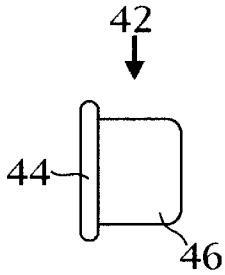
FIG. 19 is a bottom plan view of the end cap.
Figure 20:
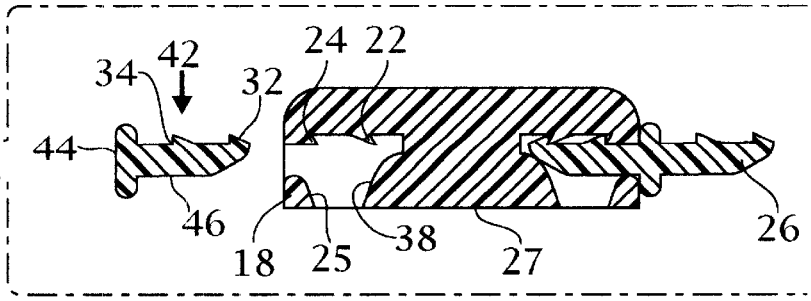
FIG. 20 shows the end cap about to be inserted into the opening in the piece.
Figure 21:
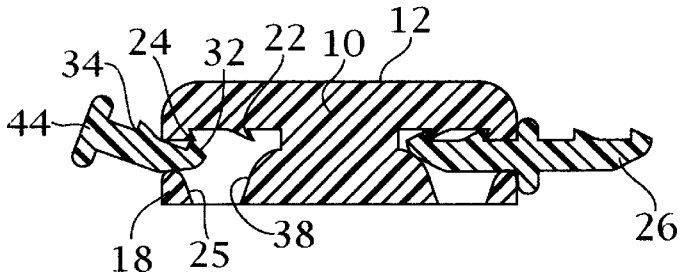
FIG. 21 shows the end cap angled with the arm inserted in the opening.
Figure 22:
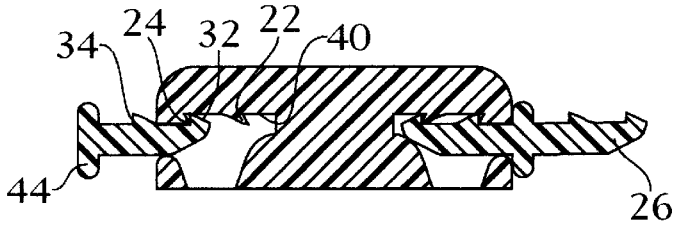
FIG. 22 shows the end cap leveraged against the lip of the opening.
Figure 23:
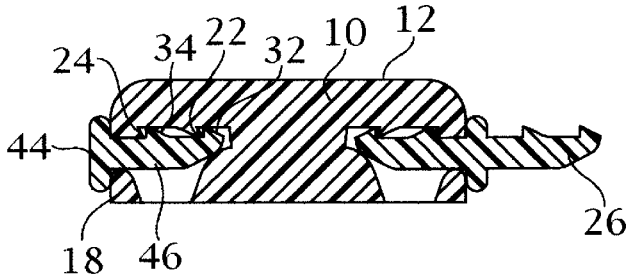
FIG. 23 shows the end cap pushed inwardly to lock the end cap with the piece.

In an alternate embodiment (FIGS. 13–14) the protrusions 32', 34' on the one side of the respective arms 30 of the connector cap 26' are rounded and are not barb-like as in the previously described embodiment. The connector cap 26' is connected to piece 10 in a manner identical with the other embodiment of connector cap 26 as previously described. However, because the protrusions 32', 34' are not barb-like, the engagement with the barbs 22, 24 formed on the inner planar surface 20 of the piece 10 is not a locking engagement and the connector cap 26' may be manually removed from the piece 10. Manually pulling the connector cap 26' from the opening 16 in the piece 10, separates the connector cap 26' from the piece 10. This embodiment may be especially useful in arranging pieces in a sequence to represent a given code when changes are required and/or the person wants to consider the overall effect of the sequence before connecting the separate pieces in a locked configuration.

An end cap 42 has an enlarged end portion 44 and a single arm 46 substantially perpendicular thereto. The end cap 42 has only one arm but is otherwise identical to the connector cap 26 having a distal protrusion 32 and a proximal protrusion 34 formed on one side of the arm 46 (FIGS. 16–19). The end cap 42 is connected to a selected opening 16 in the piece 10 in a manner identical to the connection of the connector cap 26 as shown in FIGS. 20–23. As shown in these figures, the protrusions 32, 34 are barb-like and lock the end cap 42 to the piece 10. FIGS. 20–23 show the locking end cap 42 in the piece 10 opposite from the locking connector cap 26.

Figure 24:
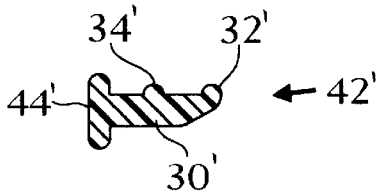
FIG. 24 is a side elevation view of an alternate embodiment of the end cap which is manually removable.

As shown in FIG. 24, the end cap 42' has rounded protrusion 32', 34' similar to the alternate embodiment of the connector cap 26' but having only one arm 30'. The alternate embodiment with the rounded protrusions 32', 34' is manually removable from the opening 16 in the piece 10. It is inserted into the opening 16 in a manner similar to the end cap 42 with the barb-like protrusions.

Figure 25:
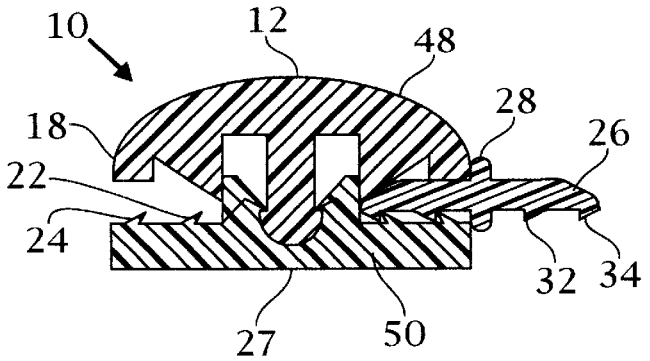
FIG. 25 is a cutaway side view showing the planar surface near the bottom of the piece and the connector cap engaged therein.

As previously noted, the piece 10 may be formed with the planar surface 20 near the bottom as shown in FIG. 25. The connector cap 26 is inserted with the protrusions 32, 34 oriented toward the bottom 27 of the piece 10. The face 12 may be curved as shown in FIG. 25. Also, because of molding and manufacturing considerations, the piece 10 may be made of an upper segment 48 and a lower segment 50 which are interlocked.

Figure 26:
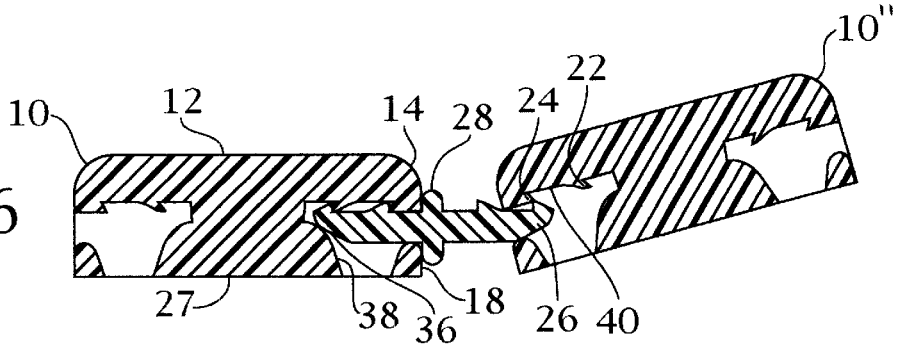
FIG. 26 shows a piece being angled to a connector cap which is locked in another piece.
Figure 27:
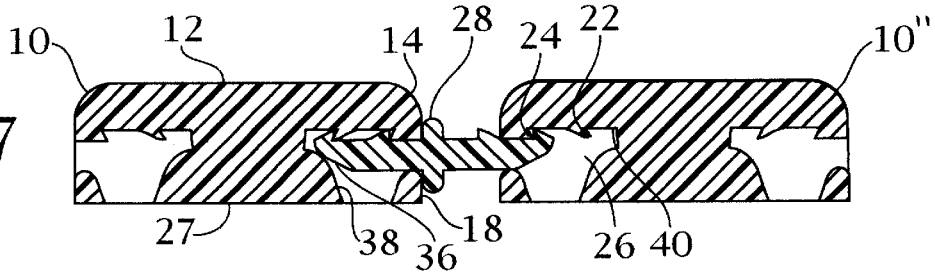
FIG. 27 shows the connector cap leveraged against the lip of the adjoining piece.
Figure 28:
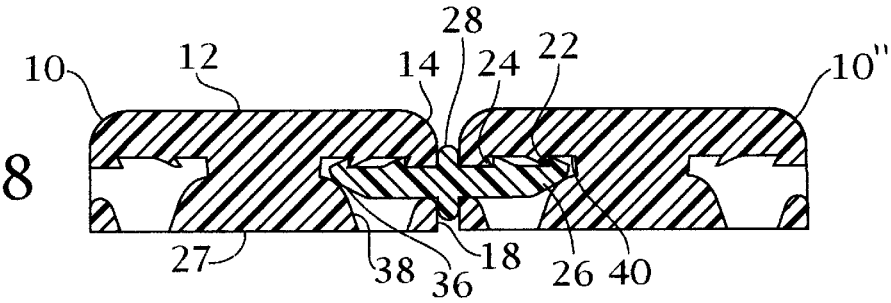
FIG. 28 shows the two pieces pushed together to be interconnected.

Two pieces 10 are joined to one another by a connector cap 26 as shown in FIGS. 26–28. The connector cap 26 is locked in a first piece 12 and the connector cap 26 is angularly inserted into a second piece 10". The second piece 10" is adjusted to leverage the connector cap against the lip 18" of the second piece 10". The second piece 10" is then pushed against the connector cap 26 in the first piece 10 and the two pieces are interconnected. This process is repeated to connect any number of pieces in any selected sequence.

Figure 29:
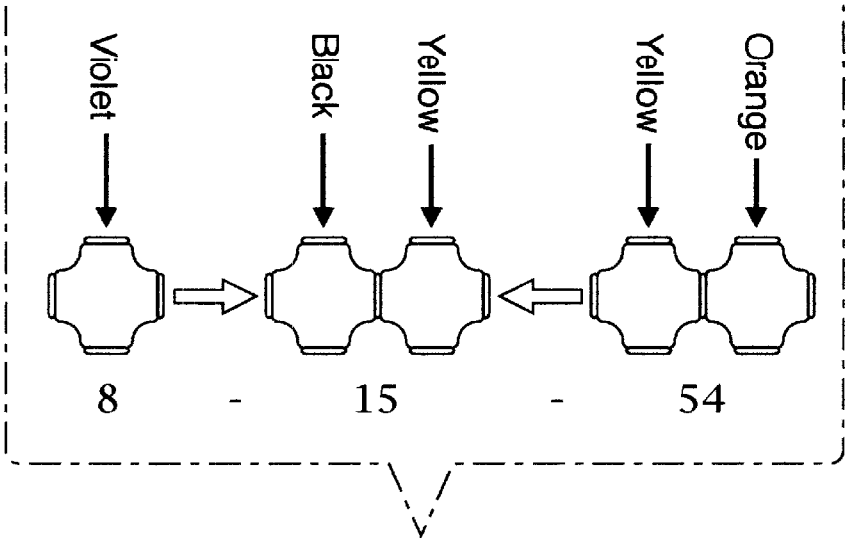
FIG. 29 is a top plan view of pieces being interconnected to represent a date.
Figure 30:
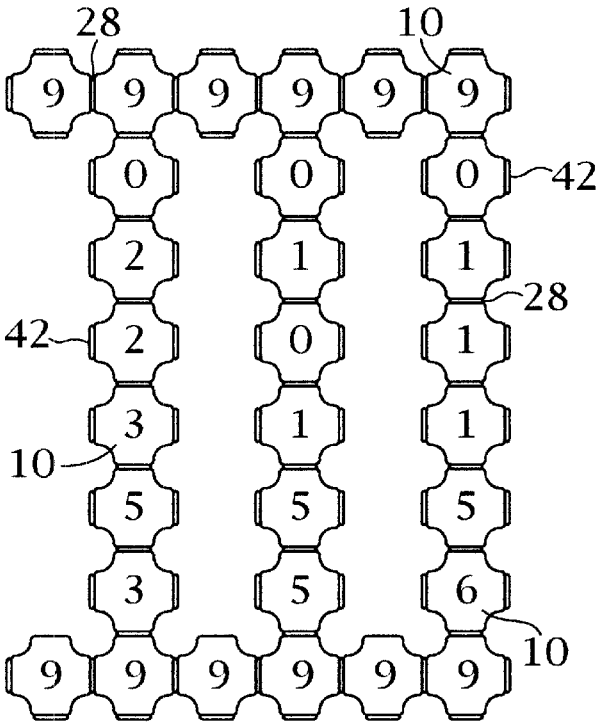
FIG. 30 is a top plan view of a portion of a bracelet in which the pieces are interconnected and have numbers thereon which are color representations.
Figure 31:
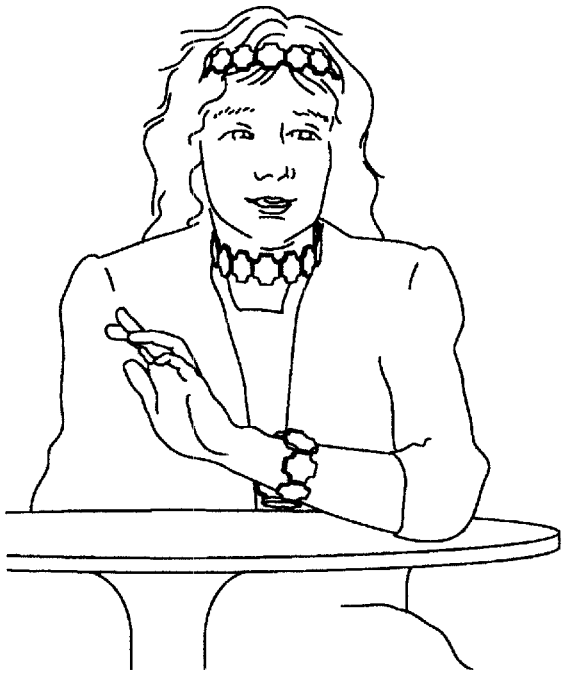
FIG. 31 is a perspective view of a woman wearing a necklace, a bracelet and a head band of the present invention.

A plurality of pieces 10 are arranged in a given sequence to form an article having a number or date which has particular significance to the person wearing the article in FIGS. 29–31. The numbers shown in FIGS. 29 and 30 are representative of the colors previously described and are shown in digit form in FIG. 30 in lieu of having colors in the figure. FIG. 29 shows two opposite outer bands of white with three connecting strips. The left strip is black, red, red, orange, green, orange representing the date Feb. 23, 1953. The center strip is black, brown, black, brown, green, green representing the date Jan. 1, 1955. The right strip is black, brown, brown, brown, green, blue representing the date Jan. 11, 1956. The article may be a necklace, bracelet or headband as shown in FIG. 31 or an ankle bracelet (not shown). The pieces 10 are connected by connector caps of which the enlarged center portion 28 are shown. End caps 42 are received in openings which are not adjacent to another piece 10.

Figure 32:
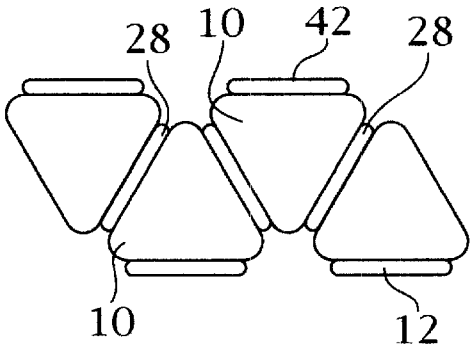
FIG. 32 is an alternative embodiment showing three-sided pieces.

As shown in FIG. 32, the pieces 10 may have three sides and are joined by connector caps of which the enlarged center portions 28 are shown. End caps 42 are also shown.

The pieces 10 preferably are formed from plastic using a manufacturing process most suitable for the type of plastic selected. The plastic may be formed incorporating the desired color as part of the manufacturing procedure. The nature of the plastic is selected based on configuration, ease of manufacture, cost and safety consideration. The pieces may also be formed from metal, the face of which has been painted or otherwise colored as desired.

Figure 33:
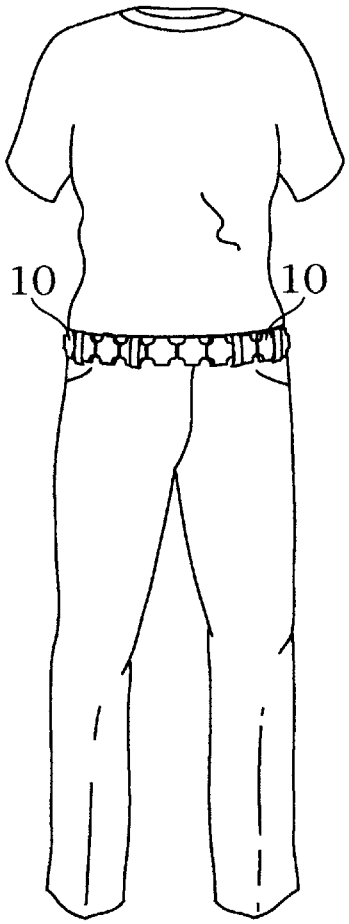
FIG. 33 is a perspective view showing the present invention used as a belt.

The dimensions of each piece are not limited and may be any desired size. For example, if each piece is a one inch square, by using six pieces arranged linearly to show a date, (Dec. 6, 2000), plus a clasp, the overall length would be approximately seven inches, which is the approximate length of a bracelet. Larger pieces may be used in forming a belt (FIG. 33). The connector caps and end caps have sizes commensurate with the pieces in which they are received. The pieces may be joined or used for any ornamental article and is not limited to the ones identified herein.

Figure 34:
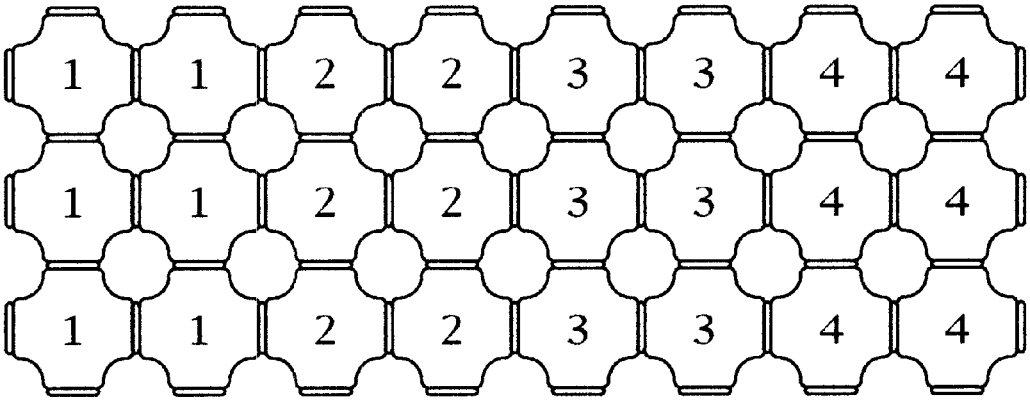
FIG. 34 is a top plan view of a combination of pieces representing a numerical sequence.

Combinations of pieces are innumerable. FIG. 34 shows several pieces of an identical color joined to provide a wider band of color than can be obtained with a single piece. A sequence of two or more colors representing corresponding digits may be joined to display a numerical sequence.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A color-coded ornamental article intended to be worn by a person, comprising a plurality of individual pieces, each of which has a colored face representing a digit according to a given code, the pieces being arranged in a given sequence to form a number or date which has particular significance to the person wearing the article, further comprising each piece having at least three sidewalls, each sidewall having a respective opening therein defining a lip opposite the colored face of the piece and an inner planar surface substantially parallel to the colored face of the piece, a distal barb and a proximal barb being formed on the inner planar surface, a connector cap having an enlarged center portion and two opposite arms extending outwardly from the center portion, each arm having a distal protrusion and a proximal protrusion formed thereon, wherein one of the arms of the cap is able to be inserted angularly into a selected one of the openings of one of the pieces, the one of the arms is then able to be leveraged against the lip of the selected opening and the connector cap is able to be pushed inwardly into the selected opening to contact the center portion of the connector cap against the sidewall of the selected opening and the lip of the selected opening, such that the protrusions on the one of the arms of the connector cap engage the barbs on the inner planar surface of the one of the pieces and the connector cap is interconnected with the one of the pieces, wherein each of the arms of the connector cap have a respective side opposite from the distal protrusion, the respective side being tapered to slope toward the distal protrusion, the selected one of the openings in the one of the pieces having an opposite wall sloping toward the inner planar surface and forming a cavity therein inwardly of the distal barb, wherein the tapered side of the one of the arms of the connector cap contacts the sloping opposite wall in the selected one of the openings when the connector cap is pushed inwardly such that the distal protrusion on the one of the arms of the connector cap is received in the cavity, the distal barb of the selected opening of the one of the pieces engaging the distal protrusion on the one of the arms and the proximal barb of the selected opening of the one of the pieces engaging the proximal protrusion on the one of the arms.

2. A color-coded ornamental article intended to be worn by a person, comprising a plurality of individual pieces, each piece having a face and at least three sidewalls, each sidewall having a respective opening therein defining a lip opposite the face and an inner planar surface substantially parallel to the face of the piece, a distal barb and a proximal barb being formed on the inner planar surface, a connector cap having an enlarged center portion and two opposite arms extending outwardly from the center portion, each arm having a distal protrusion and a proximal protrusion formed thereon, wherein one of the arms of the connector cap is able to be inserted angularly into a selected opening of a selected piece, the one of the arms is then able to be leveraged against the lip of the selected opening and the connector cap is pushed inwardly into the selected opening to abut the center portion of the connector cap against the sidewall of the selected piece and the lip of the selected opening, such that the protrusions on the one of the arms of the connector cap engage the barbs on the inner planar surface in the selected opening and the connector cap is interconnected with the selected piece, wherein the arms of the connector cap each have a side opposite from the distal protrusion, the side being tapered to slope toward the distal protrusion, the selected opening in the selected piece having an opposite wall sloping toward the inner planar surface and forming a cavity therein inwardly of the distal barb in the selected opening, wherein the tapered side on the one of the arms of the connector cap contacts the sloping opposite wall in the selected opening when the connector cap is pushed inwardly such that the distal protrusion on the one of the arms of the connector cap is received in the cavity, the distal barb in the selected opening engaging the distal protrusion on the one of the arms and the proximal barb in the selected opening engaging the proximal protrusion on the one of the arms, and wherein the opposite arm of the connector cap is similarly received in a respective opening in a second piece such that the two pieces are connected together.

* * * * *